US012264431B2

(12) United States Patent
Seo et al.

(10) Patent No.: US 12,264,431 B2
(45) Date of Patent: Apr. 1, 2025

(54) CLOTHES CARE APPARATUS

(71) Applicant: Samsung Electronics Co., Ltd., Suwon-si (KR)

(72) Inventors: Dong-Pil Seo, Suwon-si (KR); Eui Young Chang, Suwon-si (KR); Seong-Min Oak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 380 days.

(21) Appl. No.: 17/309,347

(22) PCT Filed: Oct. 14, 2019

(86) PCT No.: PCT/KR2019/013436
§ 371 (c)(1),
(2) Date: May 20, 2021

(87) PCT Pub. No.: WO2020/105864
PCT Pub. Date: May 28, 2020

(65) Prior Publication Data

US 2022/0018057 A1 Jan. 20, 2022

(30) Foreign Application Priority Data

Nov. 20, 2018 (KR) ..... 10-2018-0143299

(51) Int. Cl.
*D06F 58/12* (2006.01)
*D06F 58/20* (2006.01)

(52) U.S. Cl.
CPC ..... *D06F 58/12* (2013.01); *D06F 58/20* (2013.01)

(58) Field of Classification Search
None
See application file for complete search history.

(56) References Cited

U.S. PATENT DOCUMENTS

2010/0146805 A1 6/2010 Kim et al.
2011/0296703 A1* 12/2011 Kim ..... D06F 73/02 34/218

FOREIGN PATENT DOCUMENTS

| | | | | |
|---|---|---|---|---|
| CN | 106854824 A | * | 6/2017 | ..... D06F 57/12 |
| CN | 206680773 U | | 11/2017 | |
| JP | 2001-062198 A | | 3/2001 | |
| JP | 3762582 B2 | | 4/2006 | |
| JP | 2008-220552 A | | 9/2008 | |
| JP | 2015070930 A | | 4/2015 | |
| KR | 10-0524400 B1 | | 10/2005 | |
| KR | 20060008506 A | | 1/2006 | |

(Continued)

OTHER PUBLICATIONS

Reporter Jin-woo, Yoon, Korea Economic Daily, Aug. 21, 2018, Samsung Electronics Unveiled Clothes Cleaner "AirDresser" Aiming at LG Styler (Year: 2018).*

(Continued)

*Primary Examiner* — Rita P Adhlakha

(57) ABSTRACT

The clothes care apparatus includes a main body having a clothes care compartment, a blowing device configured such that an airflow is formed inside the clothes care compartment, a hanger configured to hang clothes in the clothes care compartment and allow the airflow generated by the blowing device to flow through the inside of the hanger, a hanger plate on which the hanger is detachably provided, and a tilting device configured to tilt the hanger plate.

10 Claims, 17 Drawing Sheets

(56) References Cited

FOREIGN PATENT DOCUMENTS

| | | | |
|---|---|---|---|
| KR | 20-2010-0009978 | U | 10/2010 |
| KR | 10-0996499 | B1 | 11/2010 |
| KR | 10-1108043 | B1 | 1/2012 |
| KR | 10-1113884 | B1 | 2/2012 |
| KR | 10-2013-0028434 | A | 3/2013 |
| KR | 10-2013-0106721 | A | 9/2013 |
| KR | 10-1525568 | B1 | 6/2015 |
| KR | 10-1600788 | B1 | 3/2016 |
| KR | 10-2017-0033657 | A | 3/2017 |

OTHER PUBLICATIONS

JP2015070930A translation (Year: 2015).*
Greenheck, Backdraft Dampers, 2024, Greenheck Fan Corporation, https://www.greenheck.com/products/air-control/dampers/backdraft-dampers (Year: 2024).*
Pottorff, History, 1970-1990 timeline cited, https://www.pottorff.com/history (Year: 2024).*
International Search Report and Written Opinion of the International Searching Authority in connection with International Application No. PCT/KR2019/013436 issued Mar. 18, 2020, 7 pages.
Office Action dated Jul. 28, 2023, in connection with Korean Patent Application No. 10-2018-0143299, 14 pages.
Office Action dated Nov. 8, 2023, in connection with Korean Patent Application No. 10-2018-0143299, 6 pages.
Notice of Patent Allowance issued Feb. 20, 2024, in connection with Korean Patent Application No. 10-2018-0143299, 4 pages.

* cited by examiner

CLOTHES CARE APPARATUS

CROSS-REFERENCE TO RELATED APPLICATIONS

This application is a 371 of International Application No. PCT/KR2019/013436, filed Oct. 14, 2019, which claims priority to Korean Patent Application No. 10-2018-0143299, filed Nov. 20, 2018, the disclosures of which are herein incorporated by reference in their entirety.

BACKGROUND

1. Field

The present disclosure relates to a clothes care apparatus, and more particularly, to a clothes care apparatus capable of effectively removing dust stuck to clothes and creases of the clothes.

2. Description of Related Art

In general, clothes care apparatuses refer to apparatuses for washing or drying laundry. Among these clothes care apparatuses, a clothes care apparatus having a drying function includes a hot air supply device configured to supply hot air to an accommodation space in which clothes are accommodated to dry the clothes, and may include a steam generator configured to perform a refresh function such as crease removal, odor removal, static electricity removal, etc. of clothes and the like.

The clothes care apparatus is configured in the form of a cabinet with an accommodation compartment for accommodating clothes. An accommodation compartment for accommodating clothes is provided at an upper portion of the cabinet, and a machine compartment equipped with a steam generator or a hot air supply device is provided at a lower portion of the cabinet. The accommodation compartment and machine compartment may be separated by a partition.

This clothes care apparatus cares clothes in a manner in which wind or steam generated by the steam generator passes through the clothes hung on hangers in the accommodation compartment to remove dust stuck to the clothes.

SUMMARY

The present disclosure is directed to providing a clothes care apparatus capable of effectively removing dust stuck to clothes and creases of the clothes.

Further, the present disclosure is directed to providing a clothes care apparatus capable of varying a friction area between air discharged from an upper end of a clothes accommodating space and clothes hung on a hanger.

Further, the present disclosure is directed to providing a clothes care apparatus capable of changing a position of clothes hung on a hanger by changing a position of the hanger.

An aspect of the present disclosure provides a clothes care apparatus including a main body having a clothes care compartment, a blowing device configured such that an airflow is formed inside the clothes care compartment, a hanger configured to hang clothes in the clothes care compartment and allow the airflow generated by the blowing device to flow through the inside of the hanger, a hanger plate on which the hanger is detachably provided, and a tilting device configured to tilt the hanger plate.

The tilting device may include a motor, and a connection member connected to the motor to transmit a rotational force of the motor to the hanger plate.

The hanger may include an air supply port formed such that the airflow generated by the blowing device is introduced into the inside of the hanger, and an air outlet formed to discharge air from the air supply port to the outside.

The hanger plate may include an airflow discharge port provided to correspond to the air supply port to guide the airflow generated by the blowing device to the hanger.

The airflow discharge port may include a nozzle connected to the air supply port to supply the airflow generated by the blowing device to the hanger.

The nozzle may include at least one blade to guide the airflow to the air supply port.

The clothes care apparatus may further include a hanger installation portion to connect the hanger and the nozzle and to detachably couple the hanger to the nozzle.

A plurality of the hangers may be provided, and a plurality of the hanger plates may be provided such that each of the plurality of hangers is able to be tilted.

The connection member may include a connection bracket provided at the center of an upper surface of the hanger plate.

The connection member may include a link to connect the motor and the hanger plate to move the hanger plate.

The connection member may include a belt to connect the motor and the hanger.

The main body may include a guide part to guide the movement of the hanger plate.

The guide part may be formed to be inclined downward to limit the movement of the hanger plate.

Another aspect of the present disclosure provides a clothes care apparatus including a main body in which a clothes care compartment is formed, a blowing device configured to supply an airflow to the inside of the clothes care compartment, a hanger configured to hang clothes in the clothes care compartment and having an airflow inlet through which the airflow generated by the blowing device is introduced, a hanger plate provided with a nozzle corresponding to the airflow inlet to supply the airflow generated by the blowing device to the inside of the hanger, and a tilting device configured to change an angle of the nozzle so that the hanger plate is movable.

The tilting device may include a motor, and a connection member connected to the motor to transmit a rotational force of the motor to the hanger plate.

The connection member may include at least one of a connection bracket, a link, and a belt.

The nozzle may include at least one blade.

A plurality of the hangers may be provided, and a plurality of the hanger plates may be provided such that each of the plurality of hangers is able to be tilted.

The main body may include a guide part to guide the movement of the hanger plate.

The guide part may be formed to be inclined downward to limit the movement of the hanger plate.

According to the present disclosure, a position of clothes hung on a hanger can be changed by changing a position of the hanger, so that a friction area between air discharged from an upper end of a clothes accommodating space and the clothes hung on the hanger can be varied.

Further, according to the present disclosure, dust stuck to clothes and creases of the clothes can be effectively removed by varying the friction area between the discharged air and the clothes.

DETAILED DESCRIPTION

Figure 1:
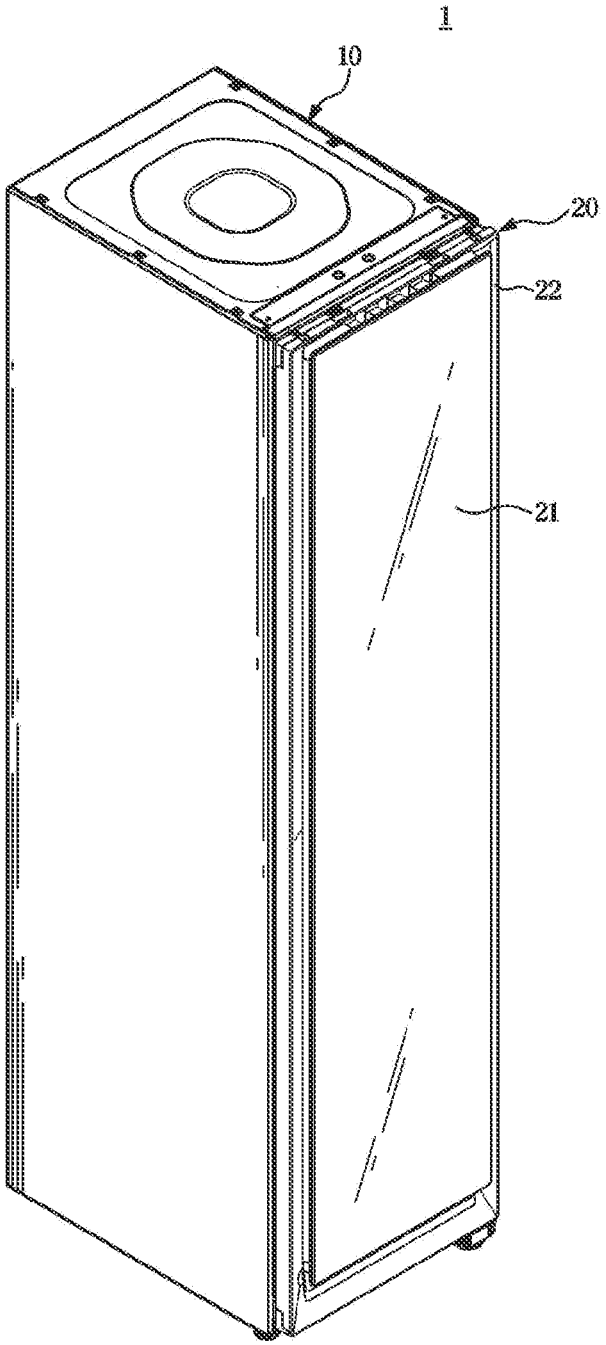
FIG. 1 is a perspective view of a clothes care apparatus according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
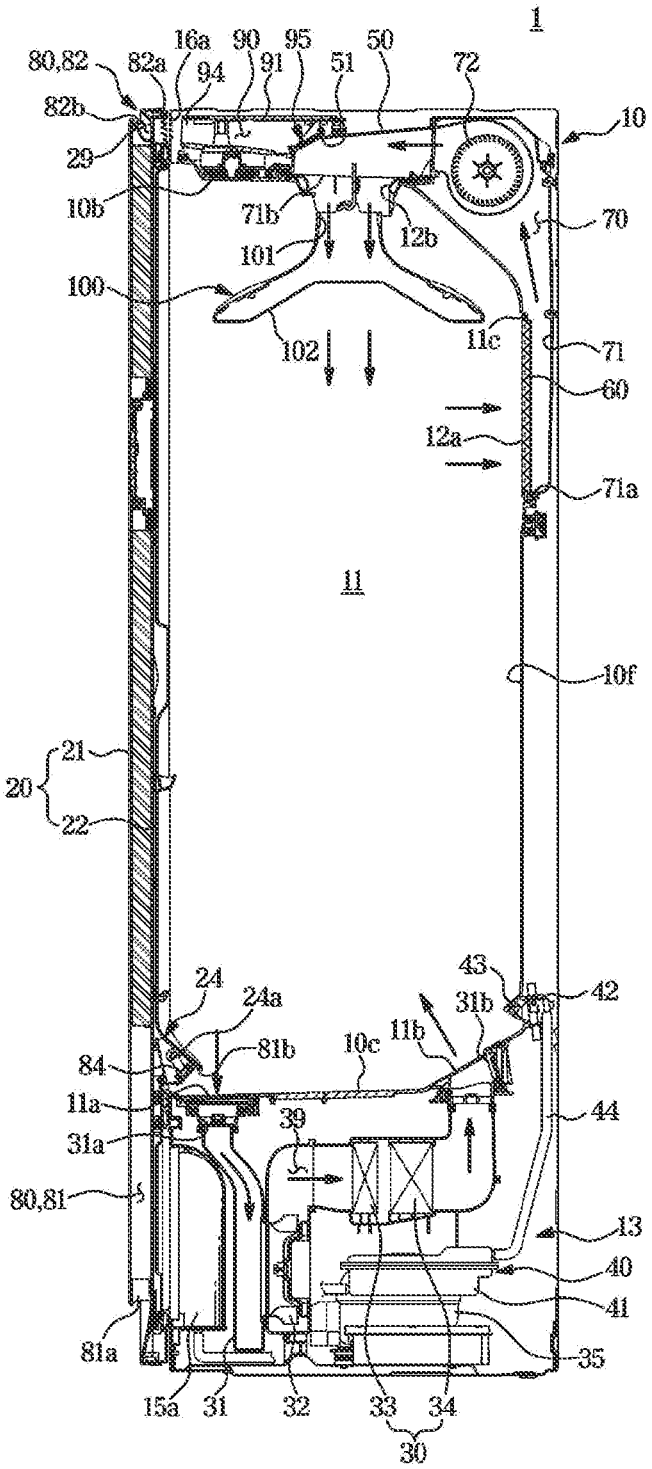
FIG. 2 is a side cross-sectional view of the clothes care apparatus according to an embodiment of the present disclosure, taken along line A-A' in FIG. 1.
Figure 3:
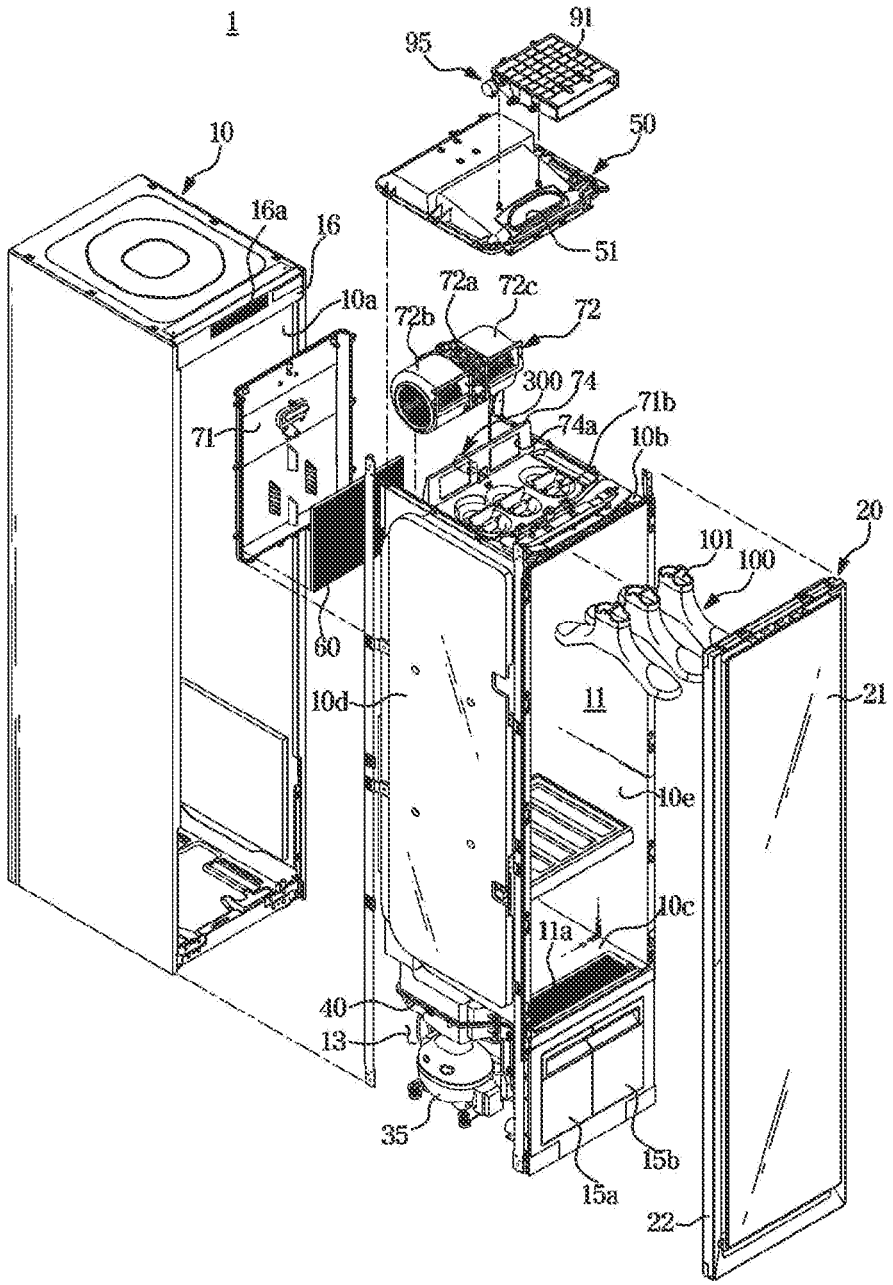
FIG. 3 is an exploded perspective view of the clothes care apparatus according to an embodiment of the present disclosure.

FIG. 1 is a perspective view of a clothes care apparatus according to an embodiment of the present disclosure, FIG. 2 is a side cross-sectional view of the clothes care apparatus according to an embodiment of the present disclosure, taken along line A-A' in FIG. 1, and FIG. 3 is an exploded perspective view of the clothes care apparatus according to an embodiment of the present disclosure.

As illustrated in FIGS. 1 to 3, a clothes care apparatus 1 may include a main body 10 forming an appearance, a door 20 rotatably coupled to the main body 10, a clothes care compartment 11 provided inside the main body 10 to accommodate and care clothes, a hanger 100 provided inside the clothes care compartment 11 to hang clothes, and a machine compartment 13 in which a heat exchanger 30 provided to dehumidify or heat air in the clothes care compartment 11 is accommodated.

The main body 10 has the clothes care compartment 11 formed therein, and may have a hexahedral shape with an open side. A door 20 is rotatably mounted at an opening 10*a* of the main body 10 to open and close the clothes care compartment 11. Although not shown in the drawings, the door 20 may be installed through a connection member such as a hinge and a link.

The clothes care compartment 11 forms a space in which clothes are accommodated. The clothes care compartment 11 may include an upper surface 10*b*, a lower surface 10*b*, a left surface 10*c*, a right surface 10*d*, and a rear surface 10*f* provided inside the main body 10. The front side of the clothes care compartment 11 is formed to be open. Accordingly, the opening of the clothes care compartment 11 may also be opened and closed by the door 20 that opens and closes the opening 10*a* of the main body 10.

A discharge bracket 16 installed at a position corresponding to a discharge flow path 29 of the door 20, which will be described later, may be provided at an upper end of the opening 10*a* of the main body 10. The discharge bracket 16 may include a plurality of discharge slits 16*a* disposed to correspond to the discharge flow path 29 of the door 20.

The clothes care compartment 11 may include a first airflow inlet 11*a*, a second airflow inlet 12*a*, a first airflow outlet 11*b*, a second airflow outlet 12*a*, and a steam outlet 43. The first airflow inlet 11*a* and the first airflow outlet 11*b* may be formed at a lower portion of the clothes care compartment 11. The first airflow inlet 11*a* may be disposed in the front of the lower surface 10*c* of the clothes care compartment 11. The first airflow outlet 11*b* may be disposed in the rear of the lower surface 10*c* of the clothes care compartment 11. The first airflow inlet 11*a* and the first airflow outlet 11*b* may be disposed adjacent to each other.

The steam outlet 43 may be disposed at a lower portion of the rear surface 10*f* of the clothes care compartment 11. The steam outlet 43 may be disposed above the first airflow outlet 11*b*.

The second airflow inlet 12*a* may be formed at an upper portion of the rear surface 10*f* of the clothes care compartment 11. The second airflow outlet 12*b* can be formed substantially in a central portion of the upper surface 10*b* of the clothes care compartment 11. The second airflow inlet 12*a* and the second airflow outlet 12*b* may be disposed adjacent to each other.

A drain container 15*a* and a water supply container 15*b* that are detachably provided from the main body 10 may be installed at a lower portion of the main body 10. The drain container 15*a* and the water supply container 15*b* may be disposed at the lower portion of the clothes care compartment 13. The drain container 15*a* is provided to facilitate the treatment of condensed water. The water supply container 15*b* stores water required to generate steam in a steam generator 40, which will be described later. The water in the water supply container 15*b* is supplied to the steam generator 40 and used to generate steam. The water supply container 15*b* may be detachably installed to the main body 10 to facilitate water replenishment.

The drain container 15*a* and the water supply container 15*b* may be provided in the front of the machine compartment 13. The machine compartment 13 is provided at the lower portion of the main body 10. The machine compartment 13 may be provided at the lower portion of the clothes care compartment 11. The machine compartment 13 may include the heat exchanger 30 provided to dehumidify or heat air in the clothes care compartment 11 as necessary.

Inside the machine compartment 13, a first blowing fan 32, the heat exchanger 30, and the steam generator 40 may be disposed.

The heat exchanger 30 is installed to supply hot air into the clothes care compartment 11. The heat exchanger 30 includes an evaporator 33, a compressor 35, and a condenser 34 through which a refrigerant circulates, and is provided to dehumidify and heat air.

As the refrigerant evaporates in the evaporator 33 of the heat exchanger 30, the evaporator 33 absorbs latent heat of the surrounding air, thereby condensing and removing moisture in the air. Also, when the refrigerant is condensed in the condenser 34 after passing through the compressor 35, the refrigerant heats the surrounding air by releasing the latent heat toward the surrounding air. That is, the evaporator 33 and the condenser 34 perform a heat exchange function, so that the air introduced into the machine compartment 13 by the first blowing fan 32 is dehumidified and heated by passing through the evaporator 33 and the condenser 34 sequentially.

The heat exchanger 30 installed in the machine compartment 13 includes a first duct 31 connecting the evaporator 33, the condenser 34, and the first blowing fan 32, and the first duct 31 may be connected to the clothes care compartment 11 to form a first circulation flow path 39 that circulates between the clothes care compartment 11 and the first duct 31.

The first duct 31 may be connected to the first airflow inlet 11*a* and the first airflow outlet 11*b* of the clothes care compartment 11. One end of the first duct 31 may be connected to the first airflow inlet 11*a* of the clothes care compartment 11, and the other end thereof may be connected to the airflow first outlet 11*b* of the clothes care compartment 11. A first duct inlet 31*a* of the first duct 31 may be connected to the first airflow inlet 11*a*, and a first duct outlet 31*b* may be connected to the first airflow outlet 11*b*.

Air in the clothes care compartment 11 is introduced into the first duct 31 through the first airflow inlet 11*a*, and the introduced air is dehumidified and introduced back into the clothes care compartment 11 through the first airflow outlet 11*b*. An embodiment of the present disclosure illustrates that the first airflow inlet is disposed in the front of the clothes care compartment and the first airflow outlet is disposed in the rear of the clothes care compartment, but the disclosure is not limited thereto. For example, the positions of the airflow inlet and the airflow outlet may be variously changed as necessary.

The first duct 31 is provided to dehumidify the air introduced through the first airflow inlet 11*a* and discharge the dehumidified air to the first airflow outlet 11*b*. The first blowing fan 32 is provided on the first duct 31 to suck the air in the clothes care compartment 11 into the first duct 31.

The machine compartment 13 may further include the steam generator 40 to receive water from the water supply container 15*b* to generate steam. The steam generator 40 may be disposed in the machine compartment 13. The steam generator 40 may include a steam generating part 41 connected to the water supply container 15*b* to receive water and generate steam, and a steam supply pipe 44 to guide the generated steam to a steam injecting part 42. The steam injecting part 42 may be disposed at the lower portion of the rear surface of the clothes care compartment 11.

A heater (not shown) is installed inside the steam generating part 41 to heat water.

The clothes care apparatus 1 includes a dehumidification flow path 80 provided in the door 20 to connect the clothes care compartment 11 and the outside when dehumidifying indoors. The dehumidification flow path 80 may be provided in the door 20. One or more of the dehumidification flow paths 80 may be formed. The door 20 may include the dehumidification flow path 80 to communicate the clothes care compartment 11 and the outside.

The door 20 includes a first door member 21 forming a front surface, and a second door member 22 coupled to the first door member 21 to form a rear surface.

The dehumidification flow path 80 may be formed between the first door member 21 and the second door member 22. At least one of the dehumidification flow paths 80 may be formed between the first door member 21 and the second door member 22. The dehumidification flow path 80 may be formed in at least one of the first door member 21 and the second door member 22.

The dehumidification flow path 80 may include a suction flow path 81 provided in the door 20 to introduce external air into the clothes care compartment 11, and a discharge flow path 29 to discharge the air in the clothes care compartment 11 to the outside.

The first door member 21 is formed in a plate shape. The first door member 21 may include a mirror, glass, panel, or the like. An embodiment of the present disclosure illustrates that the first door member 21 is a mirror formed in a plate shape, but the present disclosure is not limited thereto. For example, the first door member may include a cover made of various materials that are coupled to have a sense of unity with furniture in a room where the clothes care apparatus 1 is installed.

The first door member 21 may be installed in the front of the second door member 22 to form the appearance of the clothes care apparatus 1.

The suction flow path 81 is provided such that the air introduced through a first inlet 81*a* moves and is discharged to the clothes care compartment 11 through a first outlet 81*b*.

The suction flow path 81 may include a first damper 84 provided to open and close the first outlet 81*b*.

The door 20 includes a condensed water guide 24 to guide the movement of condensed water. The condensed water guide 24 is provided to guide condensed water formed by condensation on a rear surface of the door 20. The condensed water guide 24 may include a curved portion 24*a* formed to be inclined toward the clothes care compartment 11 from a rear surface of the second door 22.

The discharge flow path 82 is provided such that air introduced through a second inlet 82*a* moves and is discharged to the outside of the clothes care compartment 11 through a second outlet 82*b*. The discharge flow path 82 is provided in the door 20 to discharge the air in the clothes care compartment 11 to the outside.

The main body 10 further includes a connection flow path 90 connecting a second circulation flow path 70 and the discharge flow path 82 to transfer the air in the clothes care compartment 11 to the discharge flow path 82.

The connection flow path 90 may be provided in a top cover 50 provided above the clothes care compartment 11. The connection flow path 90 may be connected to the second circulation flow path 70. The connection flow path 90 may be formed to be branched from the second circulation flow path 70.

The connection flow path 90 may include a connection duct 91. The connection flow path 90 may be formed inside the connection duct 91. The connection duct 91 may be coupled to the top cover 50. The connection flow path 90 may be formed by coupling the connection duct 91 to the top cover 50. The top cover 50 includes a connection flow path hole 51. The connection flow path hole 51 may be formed in the front of the top cover 50.

A connection duct outlet 94 connected to the opening 10*a* of the main body 10 is formed on a front surface of the connection duct 91. The connection duct outlet 94 is formed on the front surface of the connection duct 91 so that air in the second circulation flow path 70 introduced through the connection flow path hole 51 flows into the connection flow path 90 and moves to the opening 10*a* of the main body 10 through the connection duct outlet 94.

A second damper 95 is provided inside the connection duct 91 to open and close between the second circulation flow path 70 and the connection duct 91. The second damper 95 is formed to open and close the connection flow path hole 51 of the top cover 50.

The connection duct outlet 94 of the connection duct 91 may be formed to correspond to the dehumidification flow path 80 formed in the door 20. The connection duct outlet 94 may be formed to correspond to the discharge flow path 82 in the door 20. The connection duct outlet 94 may be formed at a position corresponding to the second inlet 82*a* of the discharge flow path 82. The connection duct outlet 94 may be disposed to be connected to the second inlet 82*a* of the discharge flow path 82.

The discharge flow path 82 includes the second inlet 82*a*, and the second outlet 82*b* formed to discharge the air in the clothes care compartment 11 introduced through the second inlet 82*a* to the outside of the main body 10 and the door 20.

The second inlet 82*a* is provided in the second door member 22 of the door 20. The second inlet 82*a* is provided at an upper portion of the second door member 22. The second inlet 82*a* is formed on a rear surface of the second door member 22. The second inlet 82*a* is formed at a position corresponding to the connection duct outlet 94 of the connection duct 91. The air in the second circulation flow path 70, that is, the clothes care compartment 11 introduced through the second inlet 82*a*, is discharged to the second outlet 82*b*. The second outlet 82*b* is provided at an upper portion of the door 20. The second outlet 82*b* is formed at the upper portion of the second door member 22. The second inlet 82*a* and the second outlet 82*b* are formed to be in communication with each other. Air in the clothes care compartment 11 introduced into the second circulation flow path 70 may be discharged to the outside of the main body 10 through the connection flow path 90 the door 20 when dehumidifying the clothes care compartment 11.

Accordingly, during the dehumidification operation of the clothes care apparatus 1, the clothes care compartment 11 of the main body 10 and the inside of a room may be communicated through the dehumidification flow path 80 provided in the door 20.

The hanger 100 is installed inside the clothes care compartment 11 so that clothes may be hung thereon and supported. The hanger 100 may be installed on the upper surface 10*b* of the clothes care compartment 11. The hanger 100 may be formed in a hanger shape so that clothes may be inserted therein.

The hanger 100 is provided such that air may flow through the inside thereof. Dust or foreign matter stuck to clothes may be removed by air supplied into the hanger 100. An air supply port 101 to supply air to clothes may be formed in the hanger 100. An embodiment of the present disclosure illustrates that the air supply port is formed at an upper end of the hanger, and air supplied through the air supply port at the upper end is supplied to the inside and outside of clothes, but the disclosure is not limited thereto. For example, the air supply port may be formed in a variety of sizes at various locations so that the supplied air may be widely sprayed onto clothes.

A hanger plate 200 on which the hanger 100 is installed is provided on the upper surface 10*b* of the clothes care compartment 11. The hanger 100 may be detachably installed on the hanger plate 200. The hanger plate 200 may be in communication with the second airflow outlet 12*b* of the clothes care compartment 11. Air discharged through the second airflow outlet 12*b* may be transferred to the inside of the clothes by being transferred to the hanger 100 through the air supply port 101. The second airflow outlet 12*b* may be in communication with the hanger plate 200. Air discharged through the second airflow outlet 12*b* is transferred to the hanger 100 through the hanger plate 200.

An embodiment of the present disclosure illustrates that the second airflow outlet 12*b* is formed above the hanger 100, and air discharged through the second airflow outlet 12*b* is supplied to the inside of clothes, but the disclosure is not limited thereto. For example, the second airflow outlet 12*b* may be formed in a variety of sizes at various locations so that air may be sprayed on clothes in various directions.

The clothes care compartment 11 may include a blowing device 72 to flow air therein.

The clothes care compartment 11 includes a second duct 71, and the blowing device 72 may be installed inside the second duct 71. The second duct 71 may be provided to be in communication with the clothes care compartment 11 to form the second circulation flow path 70 connecting the clothes care compartment 11 and the second duct 71. The blowing device 72 may be disposed on the second circulation flow path 70.

The second duct 71 may be formed in the rear of the second airflow inlet 12*a* of the clothes care compartment 11. The second duct 71 is provided at an upper side of the rear surface of the clothes care compartment 11 and may include a filter member 60 therein. The second duct 71 may be coupled to the top cover 80 disposed above the clothes care compartment 11. The second duct 71 may be coupled to the top cover 80, and the blowing device 72 may be installed therein. The blowing device 72 is disposed in an upper rear of the clothes care compartment 11, and may include a blowing motor 72*a* to generate a rotational force, and at least one blowing fan 72*b* rotated by the blower motor. The blowing fan 72*b* may be accommodated in a fan case 72*c*. The fan case 72*c* may be coupled to a duct bracket 74 provided on the upper surface 10*b* of the clothes care compartment 11. One or more duct holes 74*a* are formed on the duct bracket 74, and the blowing fan 32 is coupled to each of the one or more duct holes 74*a*, so that air in the second duct 71 may move to the second airflow outlet 12*b* of the second duct 71.

The second duct 71 may be connected to the second airflow inlet 12*a* and the second airflow outlet 12*b* of the clothes care compartment 11. One end of the second duct 71 may be connected to the second airflow inlet 12*a* of the clothes care compartment 11, and the other end thereof may be connected to the second airflow outlet 12*b* of the clothes care compartment 11. A second duct inlet 71*a* of the second duct 71 may be connected to the second airflow inlet 12*a*, and a second duct outlet 71*b* may be connected to the second airflow outlet 12*b*.

The blowing device 72 disposed inside the second duct 71 is provided to suck air in the clothes care compartment 11 through the second airflow inlet 12*a* and discharge the sucked air to the second duct outlet 71*b* and the second airflow outlet 12*b*.

The filter element 60 is provided at the second airflow inlet 12*a* of the clothes care compartment 11. The second airflow inlet 12*a* is formed on the rear surface 10*f* of the clothes care compartment 11. A filter member mounting portion 11*c* to install the filter member 60 is provided on the rear surface 10*f* of the clothes care compartment 11. The second airflow inlet 12*a* may be formed at a position corresponding to the filter member mounting portion 11*c*.

When air in the clothes care compartment 11 is introduced into the second duct 71, the air may be filtered by the filter member 60 of the second airflow inlet 12*a*. Dust and odors may be removed from the air introduced into the second duct 71 by the filter member 60. The air filtered by the filter member 60 may be discharged to the second duct outlet 71*b* and the hanger 100 through the blowing device 72.

The filter member 60 may include a dust collecting filter (not shown) for removing dust or a means for deodorizing. The care of clothes in the clothes care compartment 11 is performed in a state in which the clothes are supported on a clothes support member 50 and the door 20 is closed. At this time, air may be circulated in the clothes care compartment 11 along the first circulation flow path 39 and the second circulation flow path 70.

The second duct outlet 71*b* of the clothes care compartment 11 may be formed on the hanger plate 200. The second duct outlet 71*b* may be disposed above the hanger 100. The second duct outlet 71*b* of the clothes care compartment 11 may be in communication with the hanger 100. The second duct outlet 71*b* may be in communication with the air supply port 101 of the hanger 100. The hanger 100 detachably installed on the hanger plate 200 may receive air from the second duct outlet 71*b* through the air supply port 101. The clothes care apparatus 1 of the present disclosure may include a tilting device 300 so that the hanger plate 200 may be tilted. The hanger plate 200 may be moved left and right at a predetermined angle by the tilting device 300. An area in which air moving in the hanger 100 encounters the clothes hung on the hanger 100 is varied by the movement of the hanger plate 200.

Figure 4:
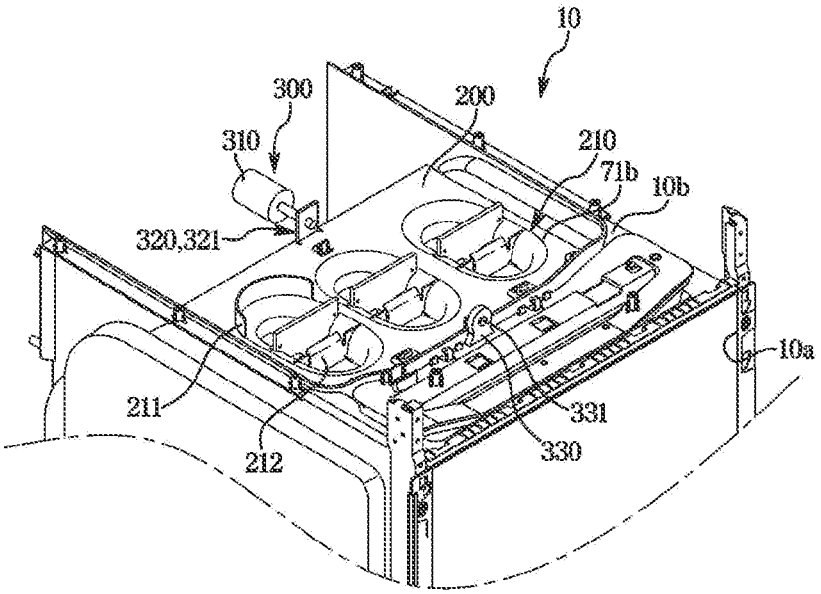
FIG. 4 is a perspective view illustrating that a tilting device is mounted in the clothes care apparatus according to an embodiment of the present disclosure.
Figure 5:
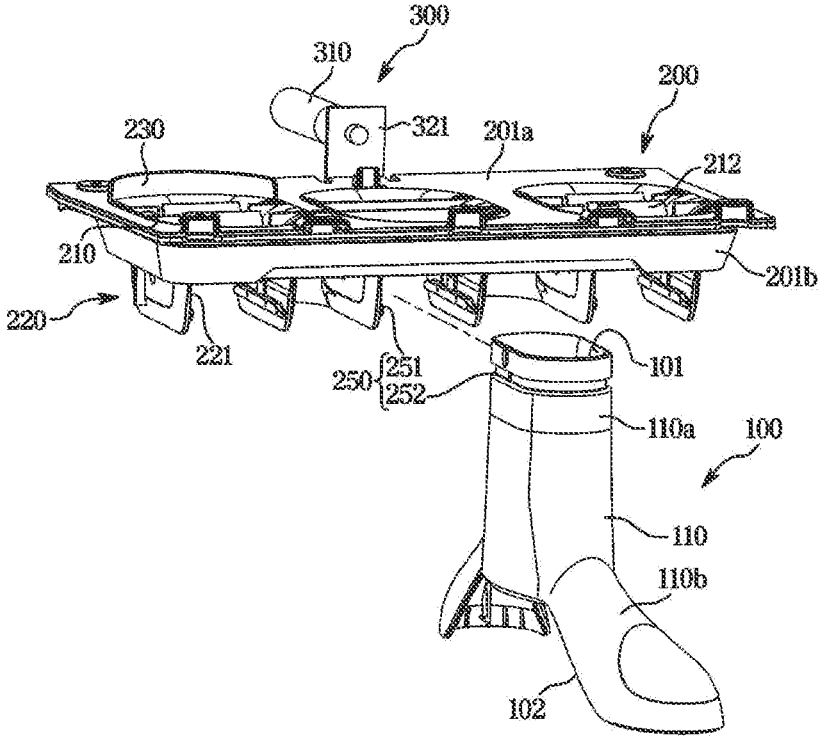
FIG. 5 is a view illustrating a hanger plate and a hanger according to an embodiment of the present disclosure.
Figure 6:
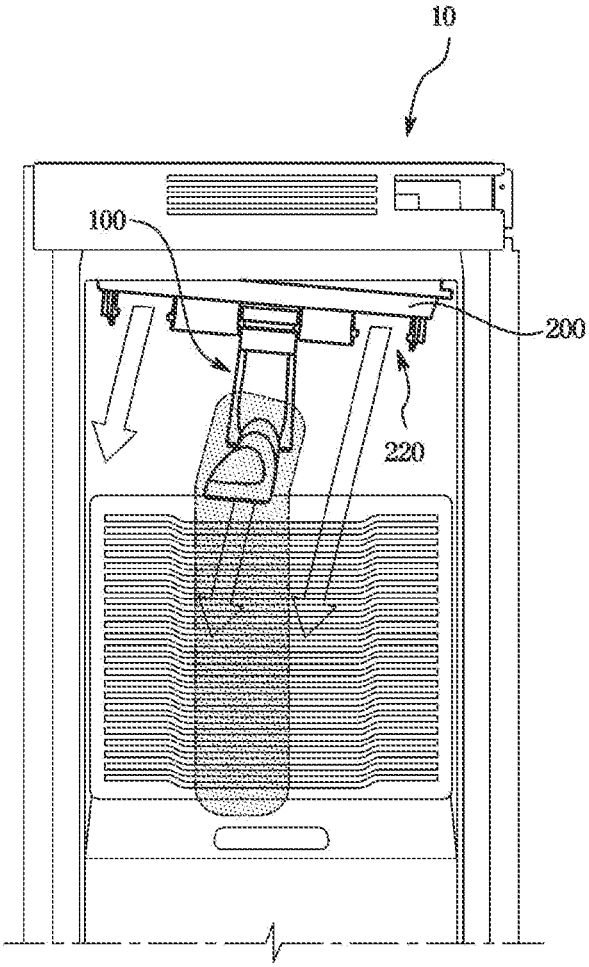
FIGS. 6 to 8 are views schematically illustrating motions of the tilting device according to an embodiment of the present disclosure.
Figure 7:
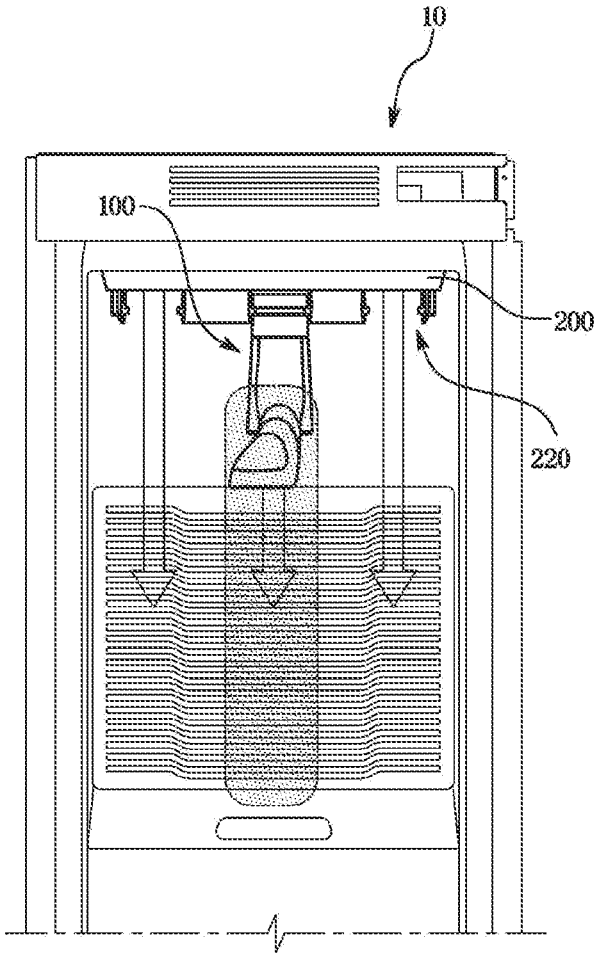
Figure 8:
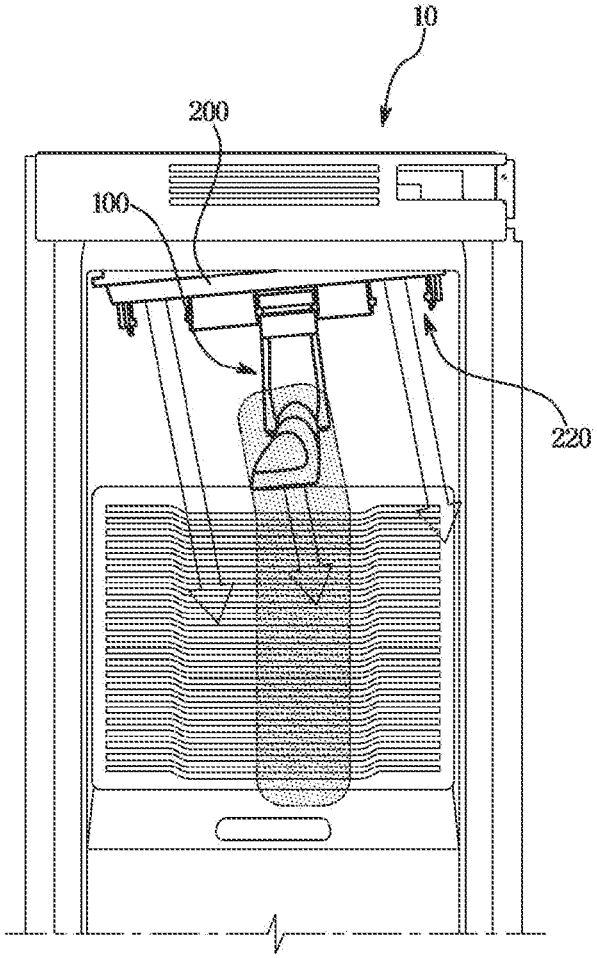

FIG. 4 is a perspective view illustrating that a tilting device is mounted in the clothes care apparatus according to an embodiment of the present disclosure, FIG. 5 is a view illustrating a hanger plate and a hanger according to an embodiment of the present disclosure, and FIGS. 6 to 8 are views schematically illustrating motions of the tilting device according to an embodiment of the present disclosure.

As illustrated in FIGS. 4 to 8, the hanger plate 200 is provided on an upper end of the main body 10. The hanger plate 200 forms at least a portion of the upper surface 10*b* of the main body 10. The hanger plate 200 may be formed in a plate shape. The hanger plate 200 may include a nozzle 220 provided to guide air blown through the blowing device 72 to clothes hung on the hanger 100.

The hanger plate 200 includes an airflow discharge part 210 provided to transfer air through the air supply port 101 of the hanger 100. The airflow discharge part 210 may include the second duct discharge port 71*b*. The airflow discharge part 210 of the hanger plate 200 is provided to correspond to the air supply port 101 of the hanger 100 so that air passed through the blowing device 72 is introduced into the hanger 100.

The airflow discharge part 210 of the hanger plate 200 may include the nozzle 220. The nozzle 220 may be disposed at a lower portion of the airflow discharge part 210. The nozzle 220 may be disposed on the upper surface 10*b* of the main body 10. One end of the nozzle 220 may be connected to the second duct outlet 71*b*, and the other end thereof may be connected to the hanger 100 or the second airflow outlet 12*b*. An opening formed at one end of the nozzle 220 may be referred to as the second duct outlet 71*b*, and an opening formed at the other end of the nozzle 220 may be referred to as the second airflow outlet 12*b*. Air blown by the blowing device 72 through the nozzle 220 may be guided to the outside and inside of clothes hung on the hanger 100.

The nozzle 220 may be provided to correspond to the airflow discharge part 210 of the hanger plate 200. An embodiment of the present disclosure illustrates that three of the airflow discharge parts 210 are formed, but the present disclosure is not limited thereto. For example, the number of airflow discharge parts may be three or more or less. Also, the number of nozzles may be three or more or less.

Because the three nozzles have the same configuration, one of the nozzles will be described below.

The nozzle 220 may include a blade 212 provided to guide an airflow to the hanger 100. One or more of the blades 212 may be formed. The blade 212 may be provided to guide air blown from the blowing device 72 to the hanger 100. The blade 212 may be provided on a flow path to guide an airflow to the air supply port 101 of the hanger 100. The blade 212 may be formed to guide air discharged in a front-rear direction of the main body 10 by the blowing device 72 in a downward direction. The blade 212 may have a portion formed to be inclined downward from the rear to the front to guide an airflow downward.

The airflow discharge part 210 may include a guide rib 230. The guide rib 230 is provided to guide air blown by the blowing device 72 to the nozzle 220. The guide rib 230 guides such that the air discharged from the blowing device 72 is distributed to the three nozzles. The guide rib 230 may be provided to block a part of air that is discharged from the blowing device 72 and directs to the one nozzle. That is, the guide rib 230 may change the movement direction of the air, which is discharged from the blowing device 72 and introduced into the nozzle disposed on a side, to the center nozzle side. Air that has not been introduced into the nozzle 220 of the side by the guide rib 230 may be introduced into the nozzle 220 of the center by the guide rib 230.

The tilting device 300 provided to move the hanger plate 200 at the predetermined angle may be provided. The tilting device 300 includes a motor 310 and a connection member 320 connecting the motor 310 and the hanger plate 200.

The hanger plate 200 is formed in a plate shape. The hanger plate 200 may be provided on the upper surface 10*b* of the main body 10. Three of the airflow discharge parts 210 may be disposed on the hanger plate 200 to be properly distributed. The hanger plate 200 is formed to be long left and right in a rectangular shape. The hanger plate 200 may include a first part 201*a* forming an upper surface and a second part 201*b* extending downward from the first part 201*a*. The tilting device 300 may be installed on the first part 201*a*. On the second part 201*b*, three of the nozzles 220 protruding downward may be disposed to be properly distributed to correspond to the airflow discharge part 210.

The tilting device 300 may be disposed in the rear of the hanger plate 200. The motor 310 may be installed on the upper surface 10*b* of the main body 10.

A motor shaft 311 of the motor 310 is connected through the hanger plate 200 and the connection member 320. The connection member 320 includes a connection bracket 321. The connection bracket 321 is formed at the center of the first part 201*a* of the hanger plate 200. The connection bracket 321 may be formed to extend upward from a rear end of the first portion 201*a* of the hanger plate 200.

A rotation bracket 330 is provided in the front of the first part 201*a* of the hanger plate 200 to support the left and right movement of the hanger plate 200. The hanger plate 200 may be connected to the center of the rotation bracket 330 through a rotation shaft 331. The rotation bracket 330 may be disposed at a position facing the motor 310 installed on the hanger plate 200.

Accordingly, the hanger plate 200 receives a driving force from the motor 310 and may perform the left and right seesaw movement around the rotation shaft 331. The hanger plate 200 may be moved left and right at the predetermined angle by the motor 310. In this case, an area in which clothes hung on the hanger 100 connected to the hanger plate 200 encounters air and wind transferred from the hanger 100 may be changed, and dust removal and crease removal may be performed.

The hanger plate 200 may be provided such that the hanger 100 is detachable. The hanger 100 is detachably connected to the nozzle 220 of the hanger plate 200.

The nozzle 220 may be formed in a shape corresponding to the hanger 100 so that the hanger 100 may be connected thereto. The nozzle 220 may have an opening 221 formed in a portion thereof so that the hanger 100 may be detachably connected thereto. At least a part of the nozzle 220 may be formed with the opening 221 so that the hanger 100 may be installed thereto. An embodiment of the present disclosure illustrates that the nozzle has an opening formed in the front so that the hanger is inserted into the opening from the front to the rear to be connected, but the present disclosure is not limited thereto. For example, the opening may be formed on a side of the nozzle.

The hanger 100 is formed in a clothes hanger of a substantially triangular shape.

The hanger 100 includes a hanger body 110 in which a flow path 120 is formed so that air generated by the blowing device 72 may flow therein. The air supply port 101 may be formed at an upper end of the hanger body 110. An air outlet 102 may be formed at a lower end of the hanger body 110.

An upper portion of the hanger body 110 may form a neck part 110*a*, and a lower portion thereof may form a hanging part 110*b* on which clothes are hung. The air supply port 101 may be formed at an upper end of the neck part 110*a*. An outer circumferential surface of the neck part 110*a* may be formed in a shape corresponding to the nozzle 220.

The nozzle 220 and the hanger 100 may be connected through a hanger connection part 250. The hanger connection part 250 may include a first connection part 251 formed on an inner circumferential surface of the nozzle 220 and a second connection part 252 formed on the hanger 100. The first connection part 251 may include a protrusion protruding from the inner circumferential surface of the nozzle 220. The second connection part 252 may include a groove formed at a circumference of the neck part 110*a* of the hanger 100. The first connection part 251 of the nozzle 220 and the second connection part 252 of the hanger 100 may have a shape corresponding to each other.

Figure 9:
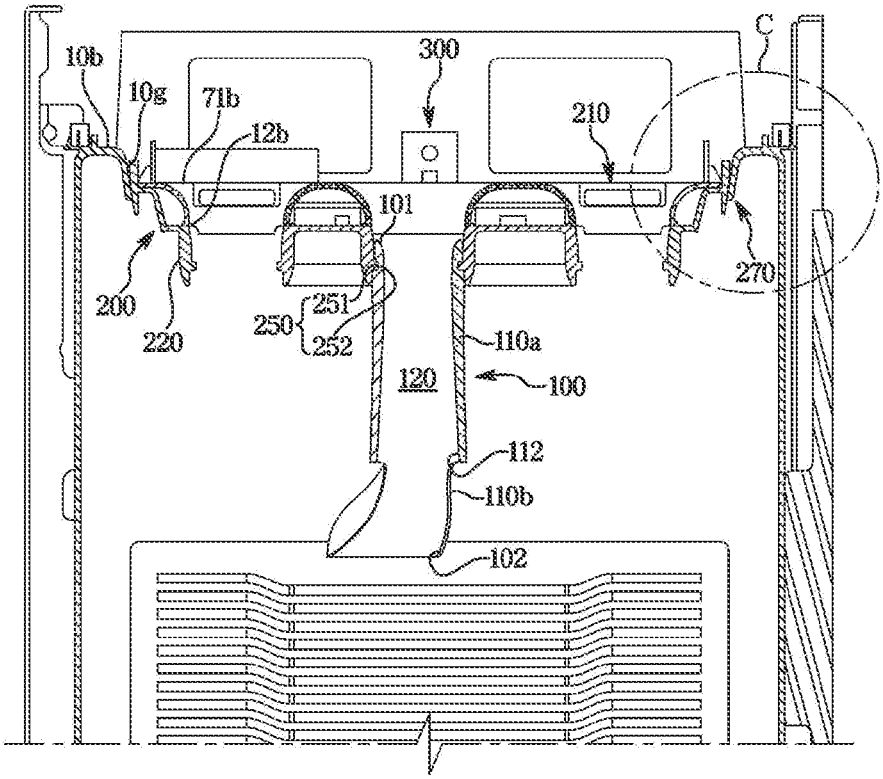
FIG. 9 is a cross-sectional view illustrating a guide of the hanger plate according to an embodiment of the present disclosure, taken along line B-B' in FIG. 4.
Figure 10:
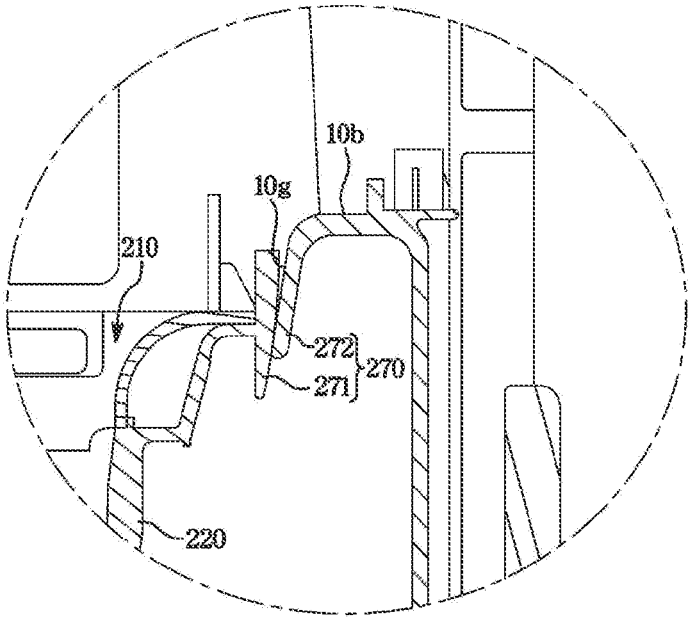
FIG. 10 is an enlarged view of part C in FIG. 9 which illustrates the guide according to an embodiment of the present disclosure.
Figure 11:
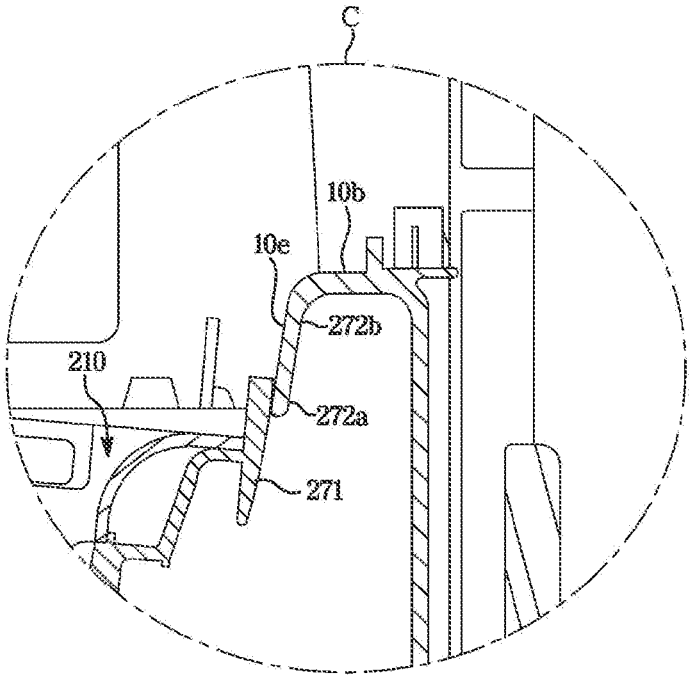
FIG. 11 is a view illustrating a movement of the guide according to an embodiment of the present disclosure.

FIG. 9 is a cross-sectional view illustrating a guide of the hanger plate according to an embodiment of the present disclosure, taken along line B-B' in FIG. 4, FIG. 10 is an enlarged view of part C in FIG. 9 which illustrates the guide according to an embodiment of the present disclosure, and FIG. 11 is a view illustrating a movement of the guide according to an embodiment of the present disclosure.

As illustrated in FIGS. 9 to 11, the hanger plate 200 is provided to be moved left and right at the predetermined angle by the tilting device 300.

The hanger plate 200 may include a guide part 270 to guide left and right movement. The guide part 270 may include a first guide part 271 provided on the hanger plate 200 and a second guide part 272 provided on the main body 10. The first guide part 271 may be formed in a curved surface protruding outward from the left and right of the first part 201*a* of the hanger plate 200.

The second guide part 272 may be formed on the upper surface 10*b* of the main body 10 to correspond to the first guide part 271. A hanger plate installation portion 10*g* to install the hanger plate 200 may be formed on the upper surface 10*b* of the main body 10. The second guide part 272 may be provided on the hanger plate installation portion 10*g* of the main body 10. The second guide part 272 may be formed to be inclined downward inward. The second guide part 272 may be formed such that a lower end thereof faces more toward the center than an upper end thereof.

Therefore, when the hanger plate 200 moves left and right at the predetermined angle, an upper portion of the first guide part 271 is interfered by the lower end of the second guide part 272 and does not move downward any more.

Figure 12:
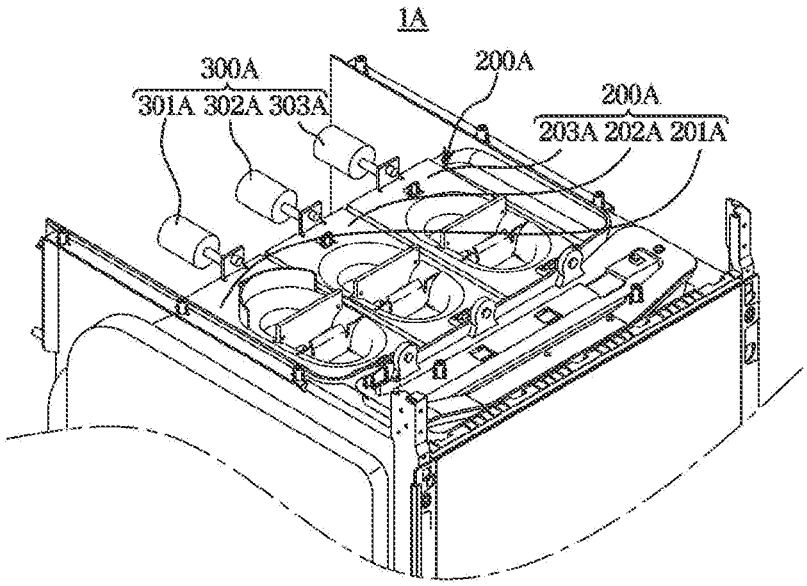
FIG. 12 is a perspective view illustrating a tilting device of a clothes care apparatus according to another embodiment of the present disclosure.
Figure 13:
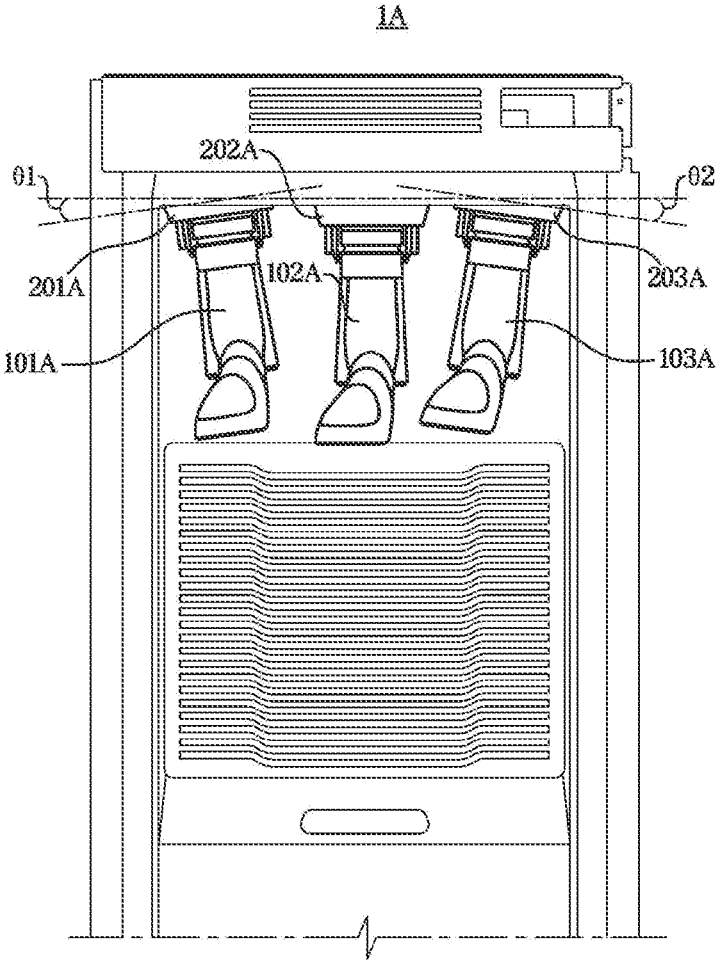
FIG. 13 is a view illustrating a motion of the tilting device according to another embodiment of the present disclosure.

FIG. 12 is a perspective view illustrating a tilting device of a clothes care apparatus according to another embodiment of the present disclosure, and FIG. 13 is a view illustrating a motion of the tilting device according to another embodiment of the present disclosure. Reference numerals which are not indicated refer to FIGS. 1 to 11.

As illustrated in FIGS. 12 and 13, a clothes care apparatus 1A includes a hanger 100A provided to hang clothes, and a hanger plate 200A on which the hanger 100A is detachably installed.

Hereinafter, descriptions of parts that overlap with those described above will be omitted.

Three of the hangers 100A may be provided. Three of the hanger plates 200A may be provided to correspond to the hangers 100A. An embodiment of the present disclosure illustrates that three of the hangers and hanger plates are each provided, but the present disclosure is not limited thereto. For example, the number of hangers and hanger plates may be three or more or less.

On each of the hanger plates 200A, a tilting device 300A may be provided to change an angle of the hanger plate 200A.

From the left side of the clothes care compartment 11, a first hanger 101A, a second hanger 102A, and a third hanger 103A may be arranged. A first hanger plate 201A, a second hanger plate 202A, and a third hanger plate 203A may be disposed to correspond to each of the hangers 100A.

The first hanger 101A is detachably connected to the first hanger plate 201A. The second hanger 102A is detachably connected to the second hanger plate 202A. The third hanger 103A is detachably connected to the third hanger plate 203A.

The first hanger plate 201A may be moved left and right at a predetermined angle by a first tilting device 301. The second hanger plate 202A may be moved left and right at a predetermined angle by a second tilting device 302A. The third hanger plate 203A may be moved left and right at a predetermined angle by a third tilting device 303A.

Therefore, each of the hanger plates 200A may be moved at a different angle to change a direction of wind coming out through each of the hangers 100A.

For example, the second hanger plate 202A is maintained in a horizontal state, and the first hanger plate 201A and the third hanger plate 203A may be moved. The first hanger 101A and the third hanger 103A are moved at a first angle θ1 and a second angle θ2 toward the center, respectively.

Air and wind discharged from the first hanger 101A and the third hanger 103A may be guided to clothes hung on the second hanger 102A. Dust removal and crease removal of clothes may be efficiently performed by a change in area where air and wind encounter the clothes.

Figure 14:
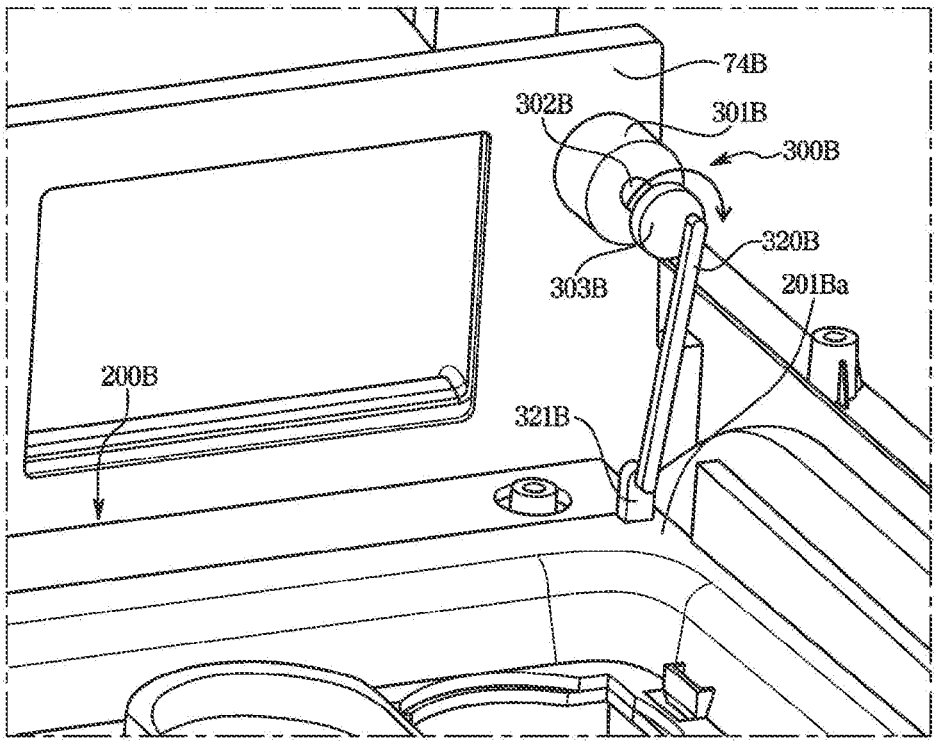
FIG. 14 is a perspective view illustrating a tilting device of a clothes care apparatus according to another embodiment of the present disclosure.
Figure 15:
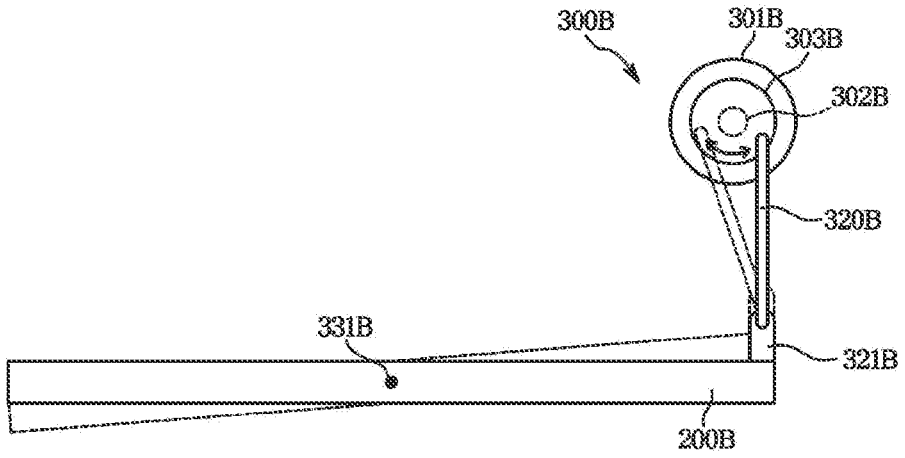
FIG. 15 is a view schematically illustrating a motion of the tilting device according to another embodiment of the present disclosure.

FIG. 14 is a perspective view illustrating a tilting device of a clothes care apparatus according to another embodiment of the present disclosure, and FIG. 15 is a view schematically illustrating a motion of the tilting device according to another embodiment of the present disclosure. Reference numerals which are not indicated refer to FIGS. 1 to 11.

As illustrated in FIGS. 14 and 15, a tilting device 300B configured to tilt a hanger plate 200B includes a motor 301B, and a link 320B connected to the motor 301B to transmit a rotational force of the motor 301B to the hanger plate 200B.

The tilting device 300B may be disposed on one side of the hanger plate 200B. The tilting device 300B may be disposed in the rear of the hanger plate 200B. The tilting device 300B may be disposed on at least one end of left and right ends of the hanger plate 200B. The motor 301B may be installed on a duct bracket 74B of the main body 10. An embodiment of the present disclosure illustrates that the motor is disposed on a right front side of the duct bracket, but the present disclosure is not limited thereto. For example, the tilting device may be disposed on the left side of the hanger plate.

The motor 301B includes a motor shaft 302B, and a rotation member 303B may be connected to the motor shaft 302B. The link 320B may be connected to the rotation member 303B to move the hanger plate 200B up and down. The link 320B may be connected to be eccentric to one side from the center of the rotation member 303B.

A motor shaft 311B of the motor 301B is connected through the hanger plate 200B and the link 320B. The link 320B may convert the rotational force of the motor 301B into up and down movement of the hanger plate 200B. The link 320B is connected to a link connection part 321B of the hanger plate 200B. The link connection part 321B may be provided on a right rear side of the hanger plate 200B. The link connection part 321B may be disposed at a right end of a first portion 201Ba of the hanger plate 200B. The link connection part 321B may be integrally formed on the hanger plate 200B.

The rotation bracket 330 is provided in the front of the first portion 201Ba of the hanger plate 200B to support the left and right movement of the hanger plate 200B. The hanger plate 200B may be connected to the center of the rotation bracket 330 through the rotation shaft 331. A pair of the rotation brackets 330 may be disposed at positions facing each other in front and rear centers of the hanger plate 200B.

One side of the hanger plate 200B is moved up and down by the link 320B, and the hanger plate 200B may perform left and right seesaw movement around the rotation shaft 331B. The hanger plate 200B may be moved left and right at a predetermined angle by the motor 301B. Accordingly, an area in which air and wind transferred from the hanger 100B encounters clothes hung on the hanger 100B connected to the hanger plate 200B may be changed, and dust removal and crease removal may be performed.

In addition, as the tilting device 300B may be disposed on one side of the hanger plate 200B, design diversity may be realized.

Figure 16:
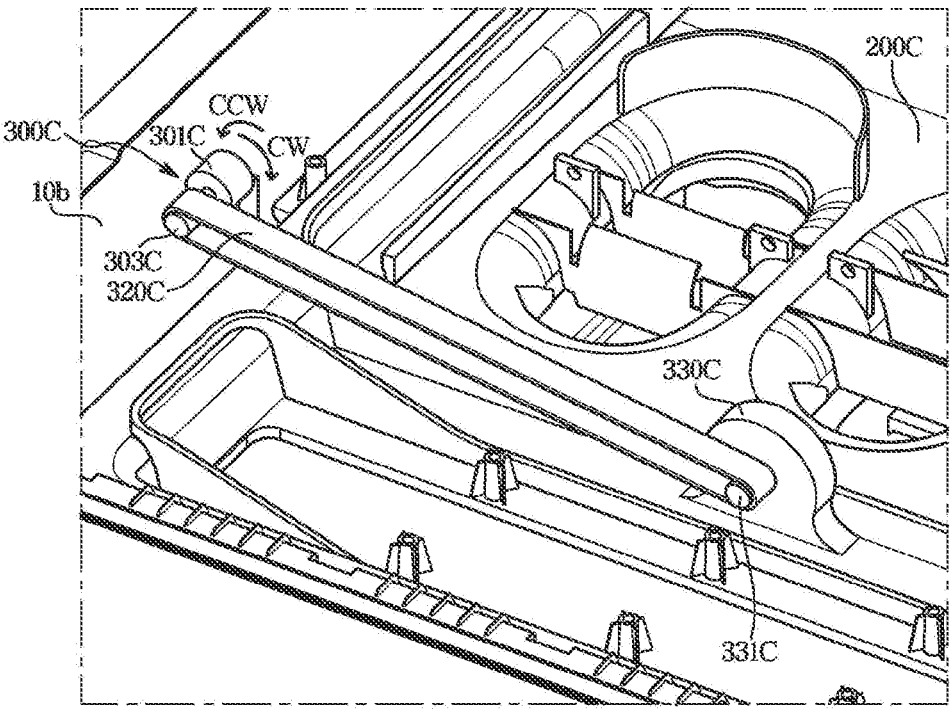
FIG. 16 is a perspective view illustrating a tilting device of a clothes care apparatus according to another embodiment of the present disclosure.
Figure 17:
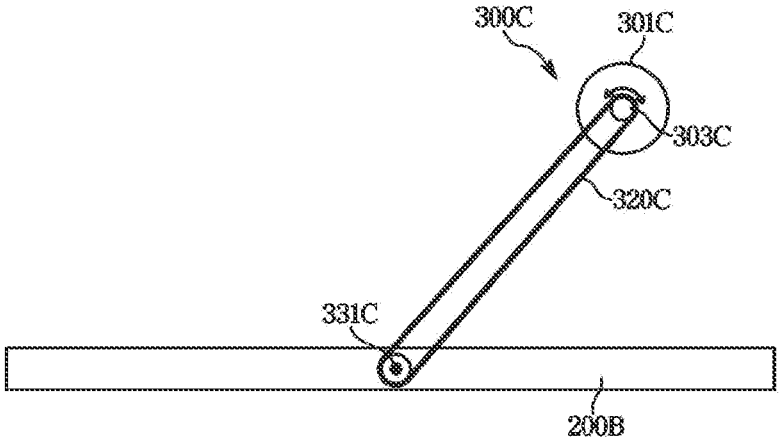
FIG. 17 is a view schematically illustrating a motion of the tilting device according to another embodiment of the present disclosure.

FIG. 16 is a perspective view illustrating a tilting device of a clothes care apparatus according to another embodiment of the present disclosure, and FIG. 17 is a view schematically illustrating a motion of the tilting device according to another embodiment of the present disclosure.

As illustrated in FIGS. 16 and 17, a tilting device 300C is provided to tilt a hanger plate 200C.

The tilting device 300C includes a motor 301C, and a belt 320C connected to the motor 301C to transmit a rotational force of the motor 301C to the hanger plate 200C.

The tilting device 300C may be disposed on one side of the hanger plate 200C. The tilting device 300C may be disposed in one front side of the hanger plate 200C. The tilting device 300C may be disposed on at least one end of left and right ends of the hanger plate 200C. The motor 301C may be installed on the main body 10. An embodiment of the present disclosure illustrates that the motor is disposed at a left upper portion of the main body, but the present disclosure is not limited thereto. For example, the tilting device may be disposed on the right side of the main body.

The motor 301C includes a motor shaft 302C, and a rotation member 303C may be connected to the motor shaft 302C. The belt 320C may be connected to the rotation member 303C to rotate the hanger plate 200C.

The motor shaft 311C of the motor 301C is connected through the hanger plate 200C and the belt 320C. The belt 320C is rotated by the motor 301C, and transmits the rotational force of the motor 301C to a rotation shaft 331C provided at the center of the hanger plate 200C.

The belt 320C is connected to the rotation shaft 331C of the hanger plate 200C. The rotation shaft 331C is provided on a rotation bracket 330C. The rotation bracket 330C may be disposed at the center of the hanger plate 200C. A pair of the rotation brackets 330C may be disposed at positions facing each other in front and rear centers of the hanger plate 200C. The rotation bracket 330C supports the hanger plate 200C to perform left and right seesaw movement. The hanger plate 200C may be connected to the center of the rotation bracket 330C through the rotation shaft 331C. The rotation shaft 331C is connected to the motor 301C by the belt 320C.

The motor 301C may move the hanger plate 200C to the left and right at a predetermined angle while rotating in a clockwise (C.W) or counterclockwise (C.C.W) direction.

The hanger plate 200C may perform left and right seesaw movement around the rotation shaft 331C. The hanger plate 200C may be moved left and right at a predetermined angle by the motor 301C. Accordingly, an area in which air and wind transferred from the hanger 100C encounters clothes hung on the hanger 100C connected to the hanger plate 200C may be changed, and dust removal and crease removal may be performed.

In addition, as the tilting device 300C may be disposed at the outside of the hanger plate 200C, design diversity may be realized even in a structure that the tilting device 300C is difficult to be located in a central portion of the hanger plate 200C.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

The invention claimed is:

1. A clothes care apparatus comprising:

a main body having a clothes care compartment;

a blowing device configured such that an airflow is formed inside the clothes care compartment;

a plurality of hangers, each hanger of the plurality of hangers configured to hang clothes in the clothes care compartment and having an airflow inlet through which the airflow generated by the blowing device is introduced;

a plurality of hanger plates, each hanger plate of the plurality of hanger plates provided with a nozzle corresponding to the airflow inlet to supply the airflow generated by the blowing device to an inside of the hanger; and a plurality of tilting devices, each tilting device configured to tilt each hanger plate of the plurality of hanger plates to change an angle of the nozzle, wherein the tilting device comprises:

a motor; and a connection member connected to the motor to transmit a rotational force of the motor to each hanger plate of the plurality of hanger plates, wherein the connection member comprises a connection bracket provided at a center of an upper surface of each hanger plate of the plurality of hanger plates, wherein the nozzle of each hanger plate comprises a blade configured to guide the airflow toward the hanger for air to flow downward, the blade having a portion formed to be inclined downward from a rear to a front, and wherein each of the plurality of hanger plates is connected to a corresponding motor of the tilting device so that nozzles on the hanger plates for each of the plurality of hangers are movable at different angles.

2. The clothes care apparatus according to claim 1, wherein each hanger of the plurality of hangers comprises:

an air supply port formed such that the airflow generated by the blowing device is introduced into an inside of the hanger; and an air outlet formed to discharge air from the air supply port to an outside.

3. The clothes care apparatus according to claim 2, wherein each hanger plate of the plurality of hanger plates comprises an airflow discharge port provided to correspond to the air supply port to guide the airflow generated by the blowing device to the hanger.

4. The clothes care apparatus according to claim 3, wherein each airflow discharge port comprises a nozzle connected to the air supply port to supply the airflow generated by the blowing device to the hanger.

5. The clothes care apparatus according to claim 4, wherein each blade includes at least one blade configured to guide the airflow to the airflow inlet.

6. The clothes care apparatus according to claim 4, wherein each hanger plate of the plurality of hanger plates further comprises a hanger installation portion to connect the hanger and the nozzle and to detachably couple the hanger to the nozzle.

7. The clothes care apparatus according to claim 1, wherein each connection member comprises, for each motor of the plurality of tilting devices and each hanger plate of the plurality of hanger plates, a link to connect the motor and the hanger plate to move the hanger plate.

8. The clothes care apparatus according to claim 1, wherein each connection member comprises, for each motor of the plurality of tilting devices and each hanger of the plurality of hangers, a belt to connect the motor and the hanger.

9. The clothes care apparatus according to claim 1, wherein the main body comprises a guide part to guide movement of each hanger plate of the plurality of hanger plates.

10. The clothes care apparatus according to claim 9, wherein the guide part is formed to be inclined downward to limit movement of each hanger plate of the plurality of hanger plates.

* * * * *